US009469454B2

(12) United States Patent
Morel et al.

(10) Patent No.: US 9,469,454 B2
(45) Date of Patent: Oct. 18, 2016

(54) PACKAGING PARTICULARLY FOR FOOD PRODUCT COMPRISING A FLEXIBLE INNER SEAL TOPPED BY A COVER

(75) Inventors: Marylise Morel, Les Lilas (FR); Daniel Fouque, Torcy (FR)

(73) Assignee: Bongrain S.A., Viroflay (FR)

( * ) Notice: Subject to any disclaimer, the term of this patent is extended or adjusted under 35 U.S.C. 154(b) by 1418 days.

(21) Appl. No.: 12/374,865

(22) PCT Filed: Jun. 27, 2007

(86) PCT No.: PCT/FR2007/001073

§ 371 (c)(1),
(2), (4) Date: Jan. 23, 2009

(87) PCT Pub. No.: WO2008/012404

PCT Pub. Date: Jan. 31, 2008

(65) Prior Publication Data

US 2009/0283435 A1 Nov. 19, 2009

(30) Foreign Application Priority Data

Jul. 27, 2006 (FR) ..... 06 06875

(51) Int. Cl.

*B65D 73/00* (2006.01)
*B65D 75/22* (2006.01)
*B65D 85/76* (2006.01)

(52) U.S. Cl.

CPC ..... *B65D 75/22* (2013.01); *B65D 85/76* (2013.01)

(58) Field of Classification Search

CPC ..... B65D 75/22; B65D 85/76; B65D 85/72; B65B 25/068; B65B 11/50; B65B 11/48
USPC ..... 206/529, 469, 532; 220/4.21, 4.24, 220/4.25, 269, 270, 268, 254.9, 254.6, 220/254.3, 254.2, 254.1, FOR. 203, 259.2, 220/259.1, 256.1, 266; 215/48, 49, 47, 250, 215/253, 254; 229/926; 383/209, 207; 426/104, 106, 112, 115, 123
See application file for complete search history.

(56) References Cited

U.S. PATENT DOCUMENTS 2,263,835 A * 11/1941 Atkinson ..... 206/526
3,456,784 A * 7/1969 Sirago ..... 206/461

(Continued)

FOREIGN PATENT DOCUMENTS

EP 560582 A2 * 9/1993 ..... B65D 75/58
FR 2 549 011 A2 1/1985

(Continued)

OTHER PUBLICATIONS

Seiichi Yagasaki, Package for Rice Cakes, Published Dec. 1992 "Translation of JP 4-367463".*

(Continued)

*Primary Examiner* — Steven A. Reynolds
(74) *Attorney, Agent, or Firm* — Alston & Bird LLP

(57) ABSTRACT

A packaging intended to contain at least one item, such as a food product, having a flexible inner seal forming a bottom and a cover delimiting with the inner seal a cavity suitable for receiving the item. The cover is more rigid than the inner seal and includes a peripheral edge sealed on a periphery of the inner seal in a position of closure of the packaging. The packaging is such that the cover is able to be cut into at least two sectors respectively provided with gripping tabs extending the edge, when traction is exerted on one of the gripping tabs, toward a zone opposite the edge while flattening the other gripping tab on the inner seal, so as to detach from the inner seal the sector whose gripping tab is subject to this traction in order to place the packaging in a partially open position.

10 Claims, 1 Drawing Sheet

(56) References Cited

U.S. PATENT DOCUMENTS

| | | | | | |
|---|---|---|---|---|---|
| 3,472,368 | A | * | 10/1969 | Hellstrom | 206/469 |
| 3,861,433 | A | * | 1/1975 | Schier et al. | 220/782 |
| 4,244,470 | A | * | 1/1981 | Burnham | 206/525 |
| 5,088,603 | A | | 2/1992 | Kirkpatrick | |
| 5,269,430 | A | * | 12/1993 | Schlaupitz et al. | 220/4.23 |
| 5,353,985 | A | * | 10/1994 | Nageli et al. | 229/123.1 |
| 5,551,567 | A | * | 9/1996 | Malone et al. | 206/469 |
| 5,992,619 | A | * | 11/1999 | Milano | 206/216 |
| 6,036,016 | A | * | 3/2000 | Arnold | 206/532 |
| 6,474,490 | B1 | * | 11/2002 | Seibel et al. | 215/232 |
| 6,935,889 | B2 | * | 8/2005 | Picardo et al. | 439/521 |
| 7,226,628 | B2 | * | 6/2007 | Cai | 426/77 |
| 2005/0183971 | A1 | * | 8/2005 | Petricca | 206/210 |

FOREIGN PATENT DOCUMENTS

| | | | | | |
|---|---|---|---|---|---|
| FR | 2 708 576 | A | | 2/1995 | |
| JP | 04367463 | A | * | 12/1992 | B65D 77/30 |
| WO | WO 02/055403 | | | 7/2002 | |

OTHER PUBLICATIONS

International Search Report and Written Opinion for PCT/FR2007/001073 filed Jun. 27, 2007.

* cited by examiner

PACKAGING PARTICULARLY FOR FOOD PRODUCT COMPRISING A FLEXIBLE INNER SEAL TOPPED BY A COVER

CROSS REFERENCE TO RELATED APPLICATIONS

This application is a national stage application filed under 35 U.S.C. 371 of International Application No. PCT/FR2007/001073, filed Jun. 27, 2007, which claims priority from French Application No. 06 06875, filed Jul. 27, 2006.

FIELD AND BACKGROUND OF THE INVENTION

The present invention relates to a packaging designed to contain at least one item, such as a food product, of the type comprising a flexible lid surmounted by a cover sealed onto this lid.

It is known practice to package cheeses in a flexible protective casing, typically bell-shaped, which is mounted on a rigid base and which has tear-off strips designed to make the casing easier to open, as described in document FR-A-2 549 011. The tear-off strips intersect at the center of the top of the casing and they terminate in gripping tabs making it possible to completely remove these strips from the casing and to then fold down toward the outside sectors of the casing evenly distributed over the circumference of the latter, in order to gain access to the cheese.

A disadvantage of this type of packaging lies particularly in the complexity of its structure and, consequently, in its high cost of manufacture.

It is also known practice to package individual portions of cheese in packagings which comprise a flexible and peelable lid forming the bottom and a hollow, semi-rigid shell which forms a cover and which is sealed via its peripheral edge to this lid.

A major disadvantage of the latter type of packagings is that the detachment of the lid to which the shell is sealed may be awkward, in order to gain access to the cheese housed inside.

SUMMARY OF THE INVENTION

One object of the present invention is to propose a packaging designed to contain at least one item, such as a food product, said packaging comprising a flexible lid forming a bottom and a cover delimiting with said lid a cavity suitable for receiving said item, said cover being more rigid than said lid and comprising a peripheral edge sealed onto a periphery of said lid in a closed position of said packaging, which remedies the aforementioned disadvantages.

Accordingly, a packaging according to the invention is such that said cover is suitable for being cut into at least two sectors respectively provided with gripping means extending said edge, during a pull exerted on one of said gripping means in the direction of a zone of said edge opposite to this gripping means while pressing the other gripping means onto said lid, so as to detach from said lid the sector the gripping means of which is subjected to this pull in order to bring the packaging into a partially open position.

It will be noted that this cover is such that the aforementioned pulling force makes it possible to cut it by forming a sector which is separated from the lid and which is clearly separated from the other sector, so that the sector thus detached thereby releases a sufficient space for access to the cavity of the packaging that makes it possible to get hold of the whole of the item that it contains.

It will also be noted that this cover according to the invention allows the user to gain easy access to the packaged item without having to get hold of it with the fingers.

According to another feature of the invention, said cover may be formed in a single piece, being of the monoblock hollow shell type.

Advantageously, said cover may be formed of a thermoplastic material of a semi-rigid type capable of allowing its wall to be torn along a substantially straight line.

Preferably, said thermoplastic material is formed of a single-layer or multilayer film which may for example be based on expanded or nonexpanded polystyrene and/or on expanded or nonexpanded polypropylene and/or on polyethylene, and which may also optionally comprise an intermediate layer based on an ethylene and vinyl alcohol copolymer.

Yet more preferably, said thermoplastic material is formed of a single-layer film based on expanded or nonexpanded polystyrene.

As a variant, said thermoplastic material may be chosen from the group consisting of the multilayers poly-styrene/ethylene and vinyl alcohol copolymer/poly-styrene (PS/EVOH/PS), expanded polypropylene/ethylene and vinyl alcohol copolymer/polyethylene (XPP/EVOH/PE), expanded polypropylene/polyethylene (XPP/PE), expanded polypropylene/ethylene and vinyl alcohol copolymer/polypropylene (XPP/EVOH/PP), expanded polypropylene/ethylene and vinyl alcohol copolymer/polystyrene (XPP/EVOH/PS), expanded polypropylene/polypropylene (XPP/PP), expanded polypropylene/polystyrene (XPP/PS), expanded polystyrene/ethylene and vinyl alcohol copolymer/polyethylene (XPS/EVOH/PE), expanded polystyrene/ethylene and vinyl alcohol copolymer/polypropylene (XPS/EVOH/PP), expanded polystyrene/ethylene and vinyl alcohol copolymer/polystyrene (XPS/EVOH/PS), expanded polystyrene/polypropylene (XPS/PP), expanded polystyrene/polystyrene (XPS/PS), expanded polystyrene/polyethylene (XPS/PE), poly-styrene/ethylene and vinyl alcohol copolymer/polyethylene (PS/EVOH/PE), polystyrene/ethylene and vinyl alcohol copolymer/polypropylene (PS/EVOH/PP), polystyrene/polyethylene (PS/PE), polystyrene/polypropylene (PS/PP), polystyrene/polystyrene (PS/PS).

According to another feature of the invention, said cover advantageously has no bendable or foldable portion for obtaining said open position.

According to another preferred feature of the invention, said cover may comprise two gripping means that are adjacent and symmetrical to one another relative to a midplane of said cover, in order to obtain a pair of said sectors that are substantially identical.

The package is partially opened by pulling on one of the two gripping means toward the top of the cover while pressing on the other gripping means in a direction opposite to said top, so as to apply a stress of the shearing type on said cover which produces the aforementioned cutting of the latter into these two sectors.

According to a particular embodiment of the invention, at least one precut line, for example consisting of a rib or a depression of less tear resistance, is formed in said cover between said gripping means and said opposite zone of said edge in order to form, via said pull, said cover sectors respectively on either side of said precut line.

It will be noted that said precut line is not similar to a tear-off strip such as those of document FR-A-2 549 011 mentioned above, because it is not designed to be torn from the cover but only capable of allowing the latter to be torn along this line.

According to another feature of the invention, each of said gripping means may consist of a tab formed in a single piece with said edge and extending beyond the latter.

It will be noted that these tabs may have, in addition to the aforementioned gripping function for the opening of the package, an entertainment function, for example by associating a particular shape of tabs with that of the cover (e.g. tabs in the shape of ears for a cover in the form of an animal head, in the shape of leaves for a cover in the form of a fruit or vegetable, in the shape of keys for a cover in the form of a chest, etc).

Advantageously, said opposite zone of said cover edge may form, in said open position, an articulation for the cover sector which is detached from said lid and separated from the other sector.

Equally advantageously, said packaging is able to be used to contain an individual portion of cheese which closely follows the walls of said lid and of said cover, and said cover may be substantially dome-shaped (e.g. a dome with a circular or oval shape) and is capable of forming a pair of said sectors which are each half-dome-shaped.

It will be noted however that the packaging according to the invention may be used in a general manner to contain any item of a semi-rigid, rigid or even crumbly type, whether or not it adheres to the wall of said cover and, for example, other food products such as chocolate or cured meats in individual portions, or even objects such as jewelry or toys.

It will also be noted that said cover may have another geometry, for example rectangular or square with rounded corners, hexagonal, octagonal, etc.

BRIEF DESCRIPTION OF THE DRAWINGS

Other features, advantages and details of the present invention will emerge on reading the following description of several exemplary embodiments of the invention, given as an illustration and nonlimitingly, said description being made with reference to the attached drawings, amongst which.

MORE DETAILED DESCRIPTION

Figure 1:
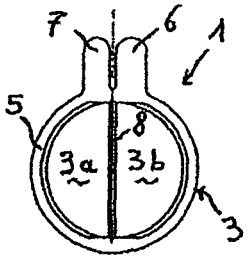
FIG. 1 is a top view of a packaging according to an exemplary embodiment of the invention before it is filled and closed by a lid.
Figure 2:
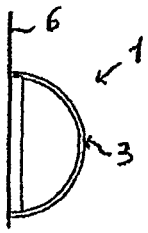
FIG. 2 is a side view of the packaging of FIG. 1.
Figure 3:
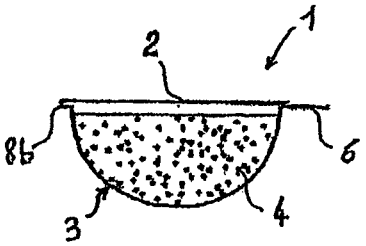
FIG. 3 is a schematic view in section of the packaging of FIGS. 1 and 2 after it has been filled and closed by this lid.
Figure 4:
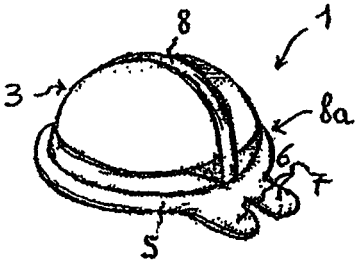
FIG. 4 is a view in perspective of this same packaging filled and closed, its cover being illustrated in a closed position.

The packaging 1 illustrated in FIGS. 1 to 4 comprises a flexible and peelable lid 2 forming the bottom and a cover 3 of the monoblock semi-rigid shell type which delimits with the lid 2 a cavity suitable for receiving an item 4, such as an individual portion of a food product (e.g. cheese, in a nonlimiting manner), and which has, in this exemplary embodiment, a substantially hemispherical dome shape. The cover 3 comprises a peripheral flat edge 5 (circular in this example) which is sealed on the periphery of the lid 2, in the closed position of the packaging 1 which is illustrated in FIGS. 3 and 4.

The edge 5 of the cover 3 is extended radially outward and for example in a coplanar manner by two gripping means 6 and 7 which are of the flexible tab type in the shape of feet and which are formed immediately next to one another, on either side of a precut line 8 formed in a substantially diametric manner in the cover 3.

The precut line 8 consists for example of a rib or a depression of less tear resistance which thus extends over a transverse midplane of the cover 3, from a zone 8*a* of the edge 5 to the zone 8*b* diametrically opposite to the latter.

This precut line 8 makes it possible to cut by shearing the cover 3 into two identical sectors 3*a* and 3*b* (in the form of half-domes in this exemplary embodiment) which are respectively provided with two gripping means 6 and 7.

Figure 5:
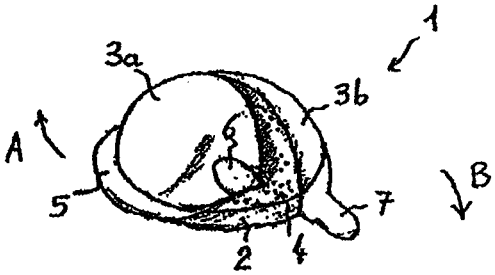
FIG. 5 is a view in perspective of the packaging of FIG. 4 in which the cover is illustrated in a position of beginning to be opened.
Figure 6:
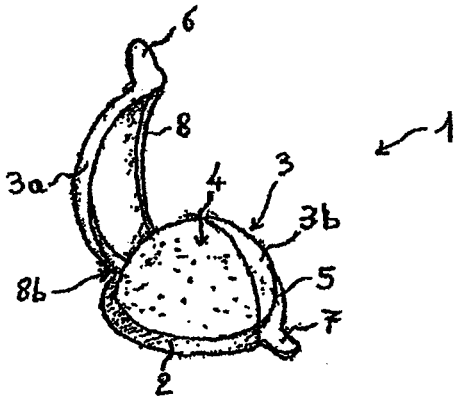
FIG. 6 is a view in perspective of the packaging of FIG. 5 in which the cover is illustrated in a partially open position allowing access to its content.

Accordingly, the user (e.g. the consumer of the food product 4 contained in the packaging 1) takes hold with his fingers of the gripping means 6 and 7 and then pulls on one of them 6 in the direction of the opposite zone 8*b* of the edge 5 (see arrow A in FIG. 5) while pressing the other gripping means 7 onto the lid 2 (see arrow B in FIG. 5), so as to detach from the lid 2 the sector 3*a* the gripping means 6 of which is subjected to this pull in order to bring the packaging 1 into the partially open position of FIG. 6. In this partially open position, it can be seen that the sector 3*a* detached from the lid 2 by pulling is therefore raised and may remain connected to the lid 2 via the opposite zone 8*b* of the edge 5 forming an articulation.

As illustrated in FIGS. 5 and 6, the user thereby cuts the cover 3 perfectly cleanly and in a straight line along the precut line 8 and may thereby easily gain access to the content 4 of the packaging without damaging or dropping this content 4.

It will be noted that the cover 3 of the packaging 1 according to the invention is based on a semi-rigid plastic material, such as a single-layer or multilayer film based on one or more thermoplastic polymers, a material designed to allow easy, clean and straight cutting of the cover 3 by the aforementioned shearing effect.

It will also be noted that the cover 3 of the packaging 1 according to the invention need not have any line or beginning of precut 8, according to a variant embodiment of FIGS. 4 to 6, the cutting of the cover 3 being able in this case nevertheless to be achieved in a clean and more or less straight manner during said pulling of the gripping means 6 and 7.

The invention claimed is:

1. A packaging designed to contain at least one food product, said packaging comprising a flexible lid forming a bottom and a shell type cover delimiting with said lid a cavity suitable for receiving said food product, said cover comprising a peripheral edge sealed onto a periphery of said lid in a closed position of said packaging, wherein said cover is provided with two gripping tabs which extend beyond the edge of the cover, said cover having a transverse precut line with less tear resistance formed between said gripping tabs which are bisected by said line so that the cover is cut into two substantially identical sectors respectively provided with these gripping tabs, said gripping tabs and sectors being symmetrical to one another relative to said line, during a pull exerted on one of these gripping tabs towards a zone of the edge of the cover which is opposite to this gripping tab being pulled while pressing the other gripping tab onto said lid, so as to detach from said lid the sector provided with this pulled gripping tab which releases access to said cavity in order to bring the packaging into a partially open position.

2. The packaging as claimed in claim 1, wherein said cover is formed in a single piece.

3. The packaging as claimed in claim 1 wherein said cover is formed of a thermoplastic material of a semi-rigid type capable of allowing its wall to be torn along a substantially straight line.

4. The packaging as claimed in claim 3, wherein said thermoplastic material is formed of a single-layer or multi-layer film which is based on expanded or nonexpanded polystyrene and/or on expanded or nonexpanded polypropylene and/or on polyethylene, and which also optionally comprises an intermediate layer based on an ethylene and vinyl alcohol copolymer.

5. The packaging as claimed in claim 1, wherein said cover has no foldable portion for obtaining said open position.

6. The packaging as claimed in claim 1, wherein said gripping tabs are adjacent and symmetrical to one another relative to a midplane of said cover, in order to obtain a pair of said sectors that are substantially identical.

7. The packaging as claimed in claim 1, wherein said precut line consists of a rib or a depression that extends said cover from between said gripping tabs to said opposite zone of said edge, in order to form, via said pull, said cover sectors respectively on either side of said precut line.

8. The packaging as claimed in claim 1, wherein each of said gripping tabs consists of a tab formed in a single piece with said edge and extending beyond the latter.

9. The packaging as claimed in claim 1, wherein said opposite zone of said edge forms, in said open position, an articulation for said cover sector which is detached from said lid and separated from the other sector.

10. The packaging as claimed in claim 1, said packaging being able to be used to contain an individual portion of cheese which closely follows the walls of said lid and of said cover, wherein said cover is substantially dome-shaped and is capable of forming a pair of said sectors which are each half-dome-shaped.

* * * * *